United States Patent [19]

Mochizuki

[11] 4,230,916

[45] Oct. 28, 1980

[54] MULTIWAY CHANGE-OVER SWITCH HAVING JOY-STICK ACTUATOR

[75] Inventor: Asaji Mochizuki, Kawasaki, Japan

[73] Assignee: Showa Musen Kogyo Kabushiki Kaisha, Tokyo, Japan

[21] Appl. No.: 954,834

[22] Filed: Oct. 26, 1978

[51] Int. Cl.[3] ..... H01H 25/04

[52] U.S. Cl. ..... 200/6 A

[58] Field of Search ..... 200/6 R, 6 A, 11 R, 200/17 R, 1 V

[56] References Cited

U.S. PATENT DOCUMENTS

| | | | |
|---|---|---|---|
| 2,793,259 | 5/1957 | Parsons | 200/6 A |
| 3,027,807 | 4/1962 | Barcus et al. | 200/6 A X |
| 4,027,119 | 5/1977 | Tezuka | 200/6 A |

FOREIGN PATENT DOCUMENTS

| | | | |
|---|---|---|---|
| 267674 | 3/1927 | United Kingdom | 200/6 A |

*Primary Examiner*—James R. Scott

*Attorney, Agent, or Firm*—Oblon, Fisher, Spivak, McClelland & Maier

[57] ABSTRACT

A multiway change-over switch which comprises an insulated casing defining a switching chamber therein and having a lobed opening in an upper portion, an upper terminal positioned on the undersurface of the top wall of the switching chamber, a rocking change-over member received in the switching chamber in contact with the upper terminal, a lower terminal rockably supporting the rocking change-over member within the switching chamber, an insulated base member secured to the bottom of the casing to support the lower terminal for vertical movement, a coiled spring positioned between the lower terminal and base member to urge the lower terminal upwardly, and at least one pair of diametrically opposite peripheral terminals extending upwardly from the periphery of the base member to surround the rocking change-over member.

8 Claims, 8 Drawing Figures

MULTIWAY CHANGE-OVER SWITCH HAVING JOY-STICK ACTUATOR

BACKGROUND OF THE INVENTION

1. Field of the Invention

This invention relates to a multiway change-over switch and more particularly, to a multiway change-over switch adapted to selectively perform switchover the connection between a plurality of contacts by rocking an operation lever in different directions.

2. Description of the Prior Art

There have been proposed and practically employed a variety of multiway change-over switches and in any one of the prior art multiway change-over switches, by rocking an operation lever in a selected direction, a change-over member engaging the lower end of the operation lever is moved in a particular direction in the horizontal direction depending upon the rocking direction of the operation lever whereby plural pairs of movable contacts secured to the undersurface of the change-over member are also horizontally moved in the same direction as the change-over member so as to cause one selected pair of movable contacts of the plural pairs of movable contacts to engage a pair of stationary contacts positioned in the horizontal direction to thereby perform a changeover operation in one direction.

However, the prior art multiway change-over switches in which the movable contacts are adapted to move in the horizontal direction have the disadvantages in that they are complicated in construction, unstable in operation and require a relatively large number of parts. Furthermore, the prior art multiway change-over switches are required to be fabricated with severe preciseness in the horizontal direction, are necessarily large in dimension in the horizontal direction and have limited freedom in designing the same.

SUMMARY OF THE INVENTION

Therefore, one principal object of the present invention is to provide a multiway change-over switch which can effectively eliminate the disadvantages inherent in the conventional multiway change-over switches referred to hereinabove.

Another object of the present invention is to provide a multiway change-over switch which comprises a rocking change-over means which is capable of rocking in different directions.

Another object of the present invention is to provide a multiway change-over switch which is simple in construction and requires a relatively small number of parts to thereby reduce production cost.

Another object of the present invention is to provide a multiway change-over switch which is compact.

Another object of the present invention is to provide a multiway change-over switch which is stable and reliable in operation.

A further object of the present invention is to provide a multiway change-over switch which is not required to have severe preciseness in dimensioning and allows for freedom in designing.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

DETAILED DESCRIPTION OF THE PREFERRED EMBODIMENTS

Figure 1:
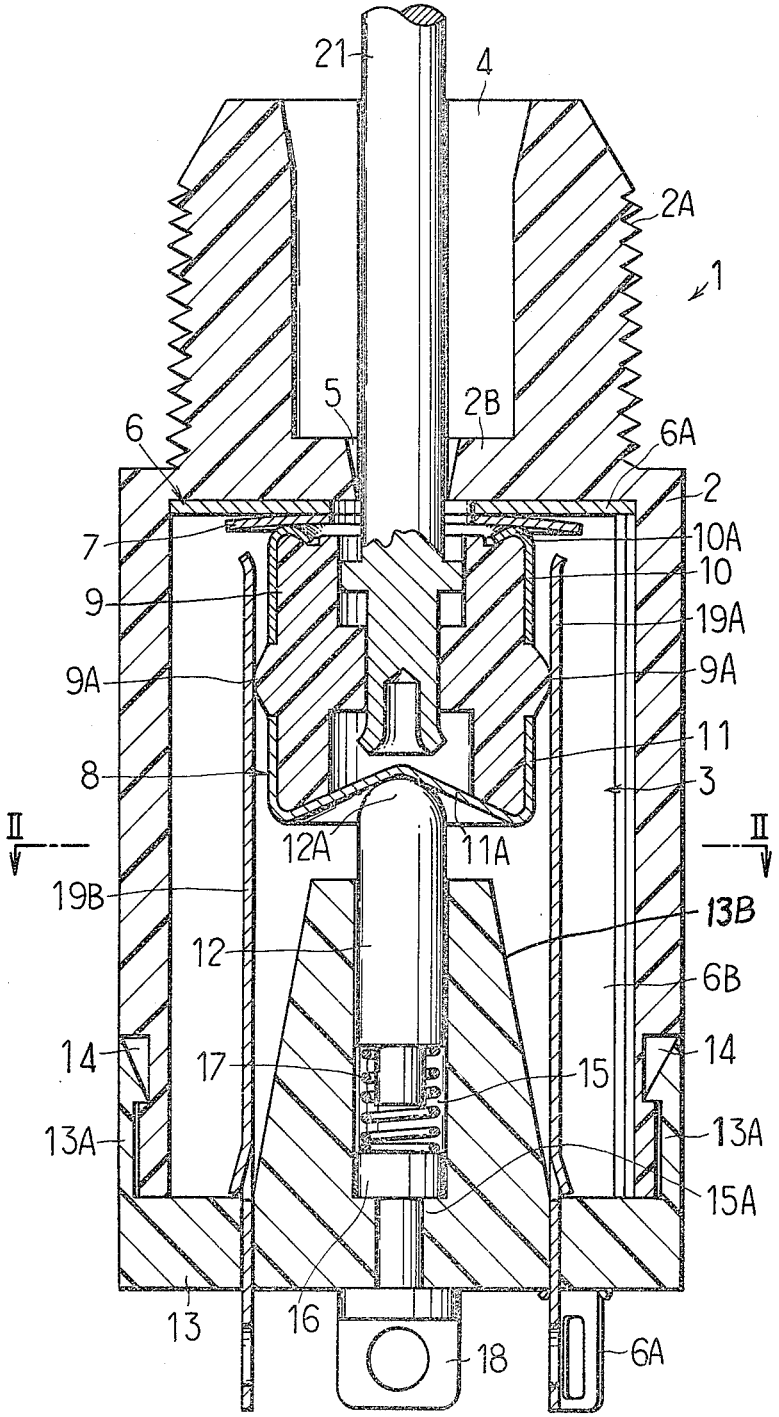
FIG. 1 is a vertically sectional view of one embodiment of the multiway change-over switch constructed in accordance with the present invention.
Figure 2:
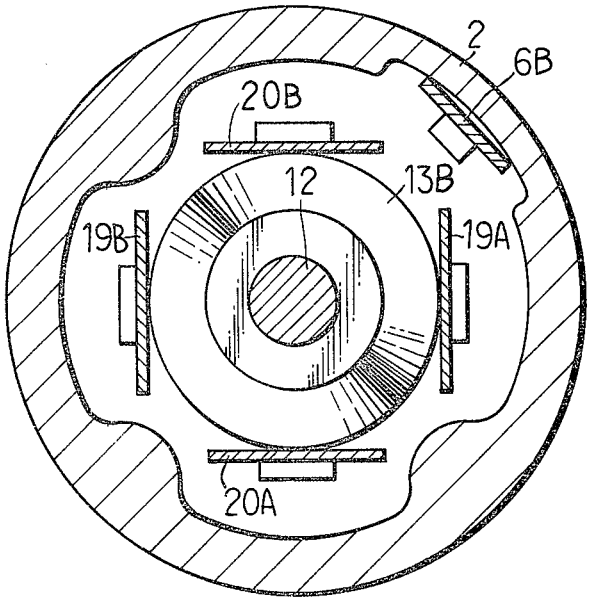
FIG. 2 is a cross-sectional view taken substantially along the line II—II of FIG. 1.
Figure 3:
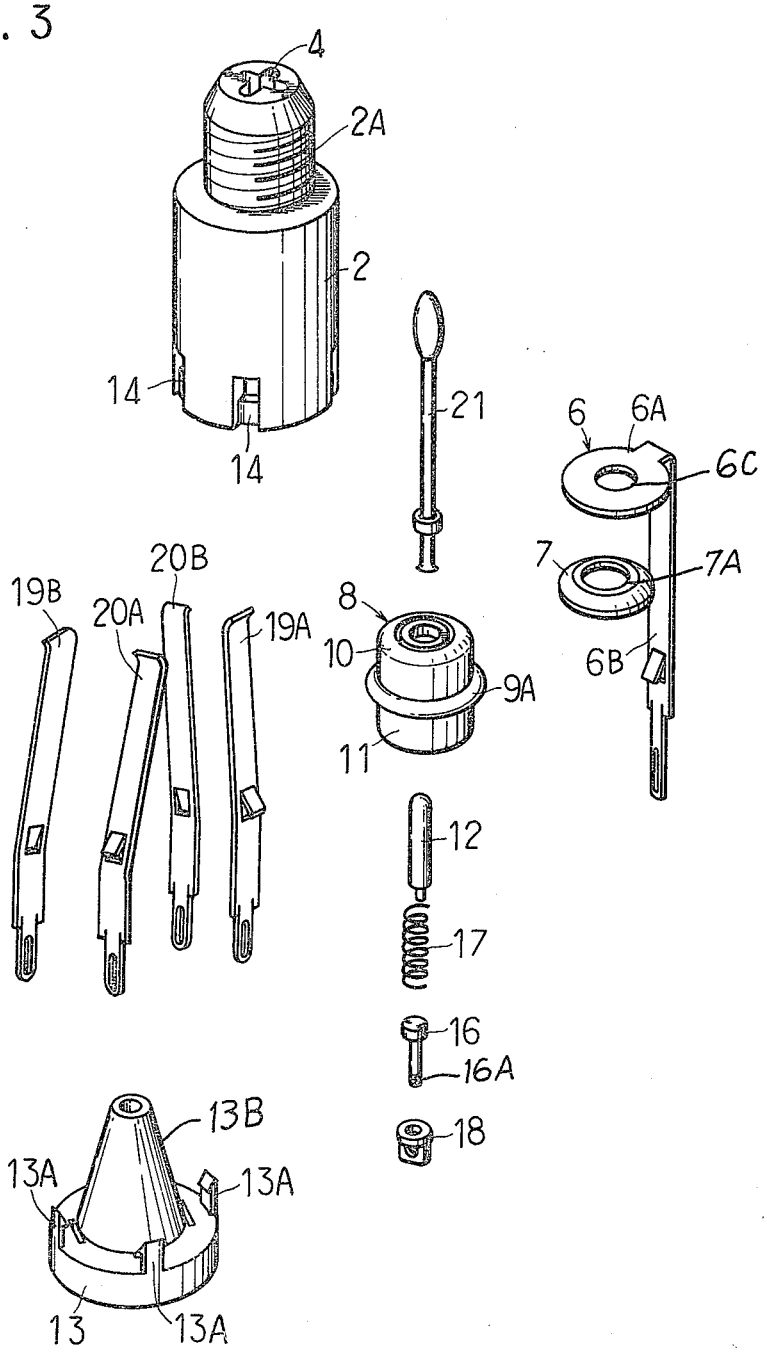
FIG. 3 is an exploded perspective view of the multiway change-over switch as shown in FIG. 1.

The present invention will be now described referring to the accompanying drawings and more particularly, to FIGS. 1 through 3 in which the invention is embodied as a four-way change-over switch. The change-over switch is generally depicted by reference numeral 1 and generally comprises a hollow cylindrical electrically insulated casing 2 formed of a plastic material such as polyphenylene sulfite or the like and defining an axial lobed switching chamber 3 in the main body portion of the casing (a five-lobed switching chamber in the illustrated embodiment). The insulated casing 2 has a reduced diameter externally threaded head portion 2A integrally connected with the main body portion of the casing 2 which defines the switching chamber 3 by means of a partition wall 2B. The reduced diameter head portion 2B of the casing 2 defines a cross opening 4 (FIG. 3) which extends in the axial direction of the head portion. The cross opening 4 is in axial alignment with the switching chamber 3 by means of a through bore 5 in the partition wall 2B and the through bore 5 gradually increases its diameter from the bottom to the top of the bore for the purpose to be described hereinafter. A brass upper terminal 6 is provided within the switching chamber 3 and includes an annular plate portion 6A in contact with the inner surface of the top wall of the switching chamber and having a center bore 6C in axial alignment with the bore 5 in the partition wall 2B and a leg portion 6B extending downwardly from a position in the outer periphery of the annular plate portion 6A at right angles to the latter along one of the lobes in the switching chamber 3. The lower end of the upper terminal leg portion 6B extends beyond the open bottom of the switching chamber 3 to the exterior of the casing 2. A rocking change-over means 8 is in abutment against the undersurface of the annular plate portion 6A of the upper terminal 6 with an annular leaf spring 7 formed of an electrically conductive material such as brass or the like interposed between the terminal annular plate portion 6A and change-over means 8. The leaf spring 7 also has a center bore 7A in axial alignment with the bore 5 in the partition wall 2B and the bore in the terminal annular plate portion 6A.

The rocking change-over means 8 comprises a substantially hollow cylindrical operation member 9 formed of an electrically insulative material such as polyacetal or the like and having a substantially H-shape as seen in vertical section. The outer periphery of the operation member 9 is formed with an annular projection 9A which has a substantially triangular shape as seen in vertical section in the center of the height of the operation member. A substantially inverted cup-shaped upper contact 10 formed of an electrically conductive material such as brass or the like surrounds the portion of the operation member 9 above the annular projection 9A and includes a bent portion 10A. The bottom portion of the cup-shaped upper contact 10 is formed with a central opening or bore in axial alignment with the bores in the partition wall and upper terminal and is bent downwardly to abut against the top of the operation member 9. A substantially cup-shaped lower contact 11 formed of the same materials as the upper contact 10 surrounds the portion of the operation member 9 below the annular projection 9A. The bottom wall 11A of the cup-shaped lower contact 11 is bent upwardly into the opening defined in the portion of the operation member 9 below the annular projection 9A for the purpose to be described hereinafter.

The rocking change-over means 8 of the above-mentioned construction is rockably supported on the semispherical upper end face 12A of a vertically movable bar-shaped lower terminal 12 formed of an electrically conductive material such as brass or the like with the spherical upper end abutting against the bent bottom wall 11A of the lower contact 11.

The lower terminal 12 is supported for vertical and slidable movement in an insulative base member 13 which forms the bottom wall of the cylindrical casing 2 and has an upwardly extending frusto-conical projection 13B in the center. The base member 13 is provided with a plurality of interengaging pawls 13A which extend uprightly at the periphery of the base member in circumferentially spaced relationship. The interengaging pawls 13A engage in the corresponding interengaging grooves 14 formed in the outer periphery of the lower end portion of the casing 2 to secure the base member 13 to the casing 2. The base member 13 is further provided with a stepped bore 15 extending through the frusto-conical center projection. A rivet-shaped spring seat 16 formed of an electrically conductive material such as copper or the like is received in the stepped bore 15 with the shank received in the bore reduced diameter portion and the head seating on the shoulder 15A defined between the reduced and enlarged diameter portions of the stepped bore 15.

A coiled spring 17 formed of an electrically conductive material such as phosphor bronze wire material is received in the enlarged diameter bore portion between the spring seat 16 and lower terminal 12 with the upper portion of the spring surrounding the reduced diameter lower end portion of the terminal 12 so as to normally resiliently urge the lower terminal end face 12A to contact the rocking change-over means 8 whereby the lower terminal 12 and lower contact 11 are maintained in their contacting condition and the upper contact 10 and upper terminal 6 are also maintained in their contacting condition with the leaf spring 7 interposed therebetween. The threaded lower end portion 16A of the shank of the rivet-shaped spring seat 16 extends through the reduced diameter portion of the stepped bore 15 in the base member 13 and a terminal 18 formed of an electrically conductive material such as brass or the like is threaded on the threaded lower end portion of the spring seat 16 so that the terminal 18 is electrically connected to the lower terminal 12 through the spring seat 16 and coiled spring 17.

The insulative base member 13 has two pairs of peripheral terminals 19A, 19B and 20A, 20B secured thereto and the peripheral terminals extend in the upper portions upwardly into the switching chamber 3 and in the lower portions downwardly through and out of the base member 13. The peripheral terminals 19A, 19B and 20A, 20B are formed of an electrically conductive material such as phosphor bronze spring material and the upper portions of the peripheral terminals extending into the switching chamber 3 peripherally surround the rocking change-over means 8 so that when the rocking change-over means 8 is in its upright neutral position as shown in FIG. 1, the peripheral terminals resiliently contact the annular projection 9A on the operation member 9, but do not contact the terminals 10 and 11.

The peripheral terminals 19A, 19A in one pair are positioned apart from each other by 180° about the rocking change-over means 8 and the peripheral terminals 20A, 20B in the other pair are also apart from each other by 180° and apart from the adjacent terminals 19A, 19B by 90° about the rocking change-over means 8, respectively. The portions of the peripheral terminals 19A, 19B and 20A, 20B which extend into the switching chamber 3 are bent inwardly or towards the rocking change-over means 8 so that the peripheral terminal portions can always resiliently contact any area or areas of the rocking change-over means 8 regardless of whatever position the rocking change-over means may assume in its rocking movement. The portions of the peripheral terminals 19A, 19B and 20A, 20B extending into the switching chamber 3 are received in the remaining four lobes in the switching chamber 3.

Operation lever 21 is such that the upper end portion thereof extends through the cross-shaped vertical opening 4 in the reduced diameter head portion 2A of the casing 2 and the lower end portion thereof extends through the aligned bores in the partition wall, upper terminal and spring into the rocking change-over means and terminates short of the lower end of the rocking change-over means. The diameter of the operation lever 21 is so selected that the lever is loosely received in the opening 4 in the casing head portion 2A, the bore 5 in the partition wall 2B and the aligned bores in the upper terminal 6 and spring 7, but snugly received in the operation member 9 of the rocking change-over means 8 so that the operation lever 21 can be manually rocked radially within a limited distance determined by the diameter of the top of the bore 5 in the partition wall 2A and the rocking change-over means 8 is also rocked following the rocking movement of the lever 21 whereby the upper or lower contact 10 or 11 selectively contacts the peripheral terminals 19A, 19B and 20A, 20B. The operation of the multiway change-over switch 1 of the above-mentioned construction will now be discussed with reference to FIGS. 1 and 4 of the accompanying drawings.

Figure 4:
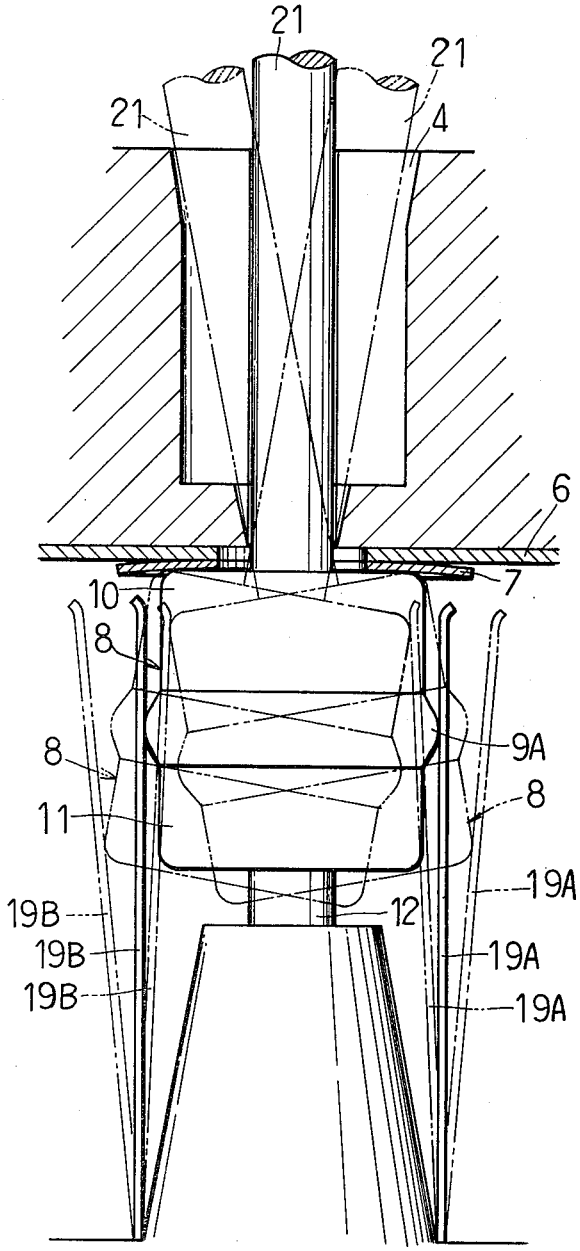
FIG. 4 is a schematic view explaining the operation of the multiway change-over switch of FIG. 1.

When the operation lever 21 is rocked leftwards from the upright position as shown in FIG. 1, for example, the leftward rocking of the operation lever 21 rocks the rocking change-over means 8 in the same direction to the position shown by the one dot-chain line in FIG. 4 to thereby cause the lower contact 11 to engage the peripheral terminal 19A so as to establish the electrical circuit between the terminals 12 and 19A and at the same time, the upper contact 10 is caused to engage the peripheral terminal 19B to establish the electrical circuit between the terminals 6 and 19B.

When the operation lever 21 is rocked from the upright position as shown in FIG. 1 in the direction away from the plane of this Figure, for example, similarly, the lower contact 12 is caused to engage the peripheral terminal 20A to establish the electrical circuit between the terminals 12 and 20A and at the same time, the upper contact 10 is caused to engage the peripheral terminal 20B to establish the electrical circuit between the terminals 6 and 20B.

On the other hand, when the operation lever 21 is rocked from the upright position of FIG. 1 in the direction towards the plane of this Figure, similarly, the lower contact 11 is caused to engage the peripheral terminal 20B to establish the electrical circuit between the terminals 12 and 20B and at the same time, the upper contact 10 is caused to engage the peripheral terminal 20A to establish the electrical circuit between the terminals 6 and 20A. The rocking movement of the rocking change-over means 8 is accelerated by the engagement between the bent bottom of the cup-shaped lower contact 11 and the semi-spherical upper end face of the lower terminal 12.

One practical application of the multiway change-over switch of the invention will be now described referring to FIGS. 5A, 5B, 5C and 5D which show the electrical circuit of motors 22, 23 adapted to adjust the direction of the back mirror of a motor vehicle incorporating the inventive multiway change-over switch 1 for changing the rotational direction of the motors 21, 22. One of the motors 22, for example, is designed to adjust the vertical direction of the back mirror whereas the other motor 23 is designed to adjust the lateral direction of the back mirror. In FIGS. 5A through 5D, reference numeral 24 denotes a common DC power source and reference numeral 25 denotes a power source switch, respectively.

Figure 5A:
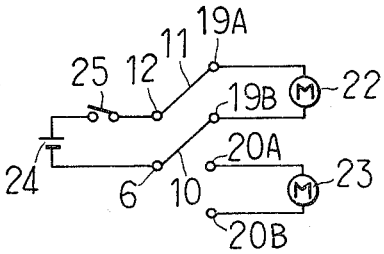
FIGS. 5A through 5D are views of the electrical circuit of motors adapted to adjust the position of the back mirror of a motor vehicle in which the multiway change-over switch is incorporated to perform change-over the connection between contacts in the circuit and also show the electrical circuit in different operational conditions.
Figure 5C:
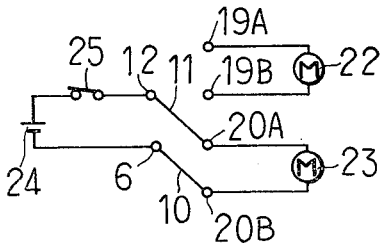
Figure 5B:
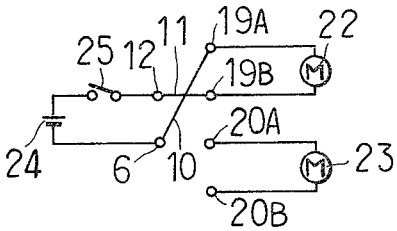
Figure 5D:
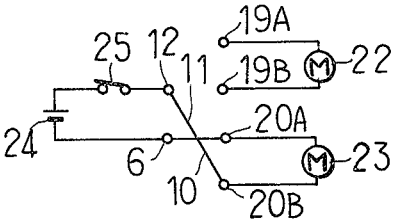

Thus, when the operation lever 21 is rocked leftwards from the upright position as seen in FIG. 1, for example, the multiway change-over switch 1 provides the circuit connection condition as shown in FIG. 5A in which the motor 22 rotates in the forward direction and the back mirror is driven upwardly. When the operation lever 21 is rocked rightwards from the upright position as seen in FIG. 1, the multiway change-over switch 1 provides the circuit connection condition as shown in FIG. 5B in which the motor 22 rotates in the reverse direction and the back mirror is driven downwardly. When the operation lever 21 is rocked away from the plane of FIG. 1 from the upright position as seen in FIG. 1, the multiway change-over switch 1 provides the circuit connection condition as seen in FIG. 5C in which the motor 23 rotates in the forward direction and the back mirror is driven rightwards. When the operation lever 21 is rocked towards the plane of FIG. 1 from the upright position therein, the multiway change-over switch 1 provides the circuit connection condition as shown in FIG. 5D in which the motor 23 rotates in the reverse direction and the back mirror is driven leftwards. Thus, by the provision of the multiway switch 1 of the invention in the electrical circuit of the motors designed to adjust the direction of the vehicular back mirror, the direction of the vehicular back mirror can be freely and remotely adjusted by the driver within the driver's cab by merely rocking the operation lever to a desired direction.

In the foregoing, although description has been made of the invention as being embodied as the multiway change-over switch employing two pairs of peripheral terminals, it is to be understood that the invention can be equally embodied as a multiway change-over switch having only one pair of peripheral terminals or three or more pairs of peripheral terminals. In such a case, the shape of the opening 4 in the reduced diameter head portion 2B of the casing 2 should be modified depending upon the number of the peripheral terminals.

And the leaf spring 7 may be eliminated if only the force of the coiled spring 17 is sufficient to cause the annular portion 6A of the upper terminal 6 to abut against the top wall of the switching chamber 3 and such modification is also within the scope of the present invention.

In the embodiment of the multiway change-over switch as described hereinabove, since the connection change-over between the contacts in the electrical circuit is effected by rocking the rocking change-over means in different directions, the construction of the switch is simpler, the number of parts can be reduced and the production cost of the switch can be reduced. Furthermore, the present invention provides a multiway change-over switch which has a relatively small size and is stable and reliable in operation. Finally, since the rocking change-over means is designed to move in different directions, freedom of designing of the switch is increased whereby the fabrication of the switch is made easy without being required to have severe preciseness in dimension.

While only one embodiment of the invention has been shown and described in detail, it will be understood that the same is for illustration purpose only and not to be taken as definition of the invention, reference being had for this purpose to the appended claims.

What is claimed as new and desired to be secured by Letters Patent of the United States is:

1. A multiway change-over switch for a circuit comprising:

an electrically insulated hollow cylindrical casing including a main body portion which defines a switching chamber and a head portion which defines a lobed opening, an upper terminal having a portion positioned on the inner surface of the top wall of said switching chamber, a rocking change-over means rockably received in said switching chamber in contact with said upper terminal, a lower terminal in abutment against the undersurface of said rocking change-over means for rockably supporting the rocking change-over means, a base member secured to the bottom of said casing and loosely receiving said lower terminal, a coiled spring positioned between said lower terminal and base member for normally urging said lower terminal against said rocking change-over means and at least one pair of peripheral terminals positioned in diametrically opposite positions in the outer periphery of said base member and having portions extending into said switching chamber to surround said rocking change-over means, said rocking change-over means including a substantially hollow cylindrical operation member having an annular projection in the center of the outer periphery against which said peripheral terminals normally abut, an upper contact surrounding the portion of said operation member above said annular projection and normally in contact with said upper terminal and a lower contact surrounding the portion of said operation member below said annular projection and normally in contact with said lower terminal such that said rocking change-over means can selectively contact said at least one pair of peripheral terminals with said upper and lower terminals and complete said circuit.

2. The multiway change-over switch as set forth in claim 1, in which said lobed opening in the head portion of the casing has a cross shape as seen in transverse cross-section and said switch further includes an operation lever having a portion loosely received in the lobed opening for rocking movement in the opening and a portion snugly fitted in said rocking change-over means so that when the operation lever is rocked, the rocking change-over means rocks within said switching chamber together with the operation lever to complete said circuit.

3. The multiway change-over means as set forth in claim 1, in which said main body portion and head portion of the casing are integrally connected together by means of an annular partition wall positioned between the casing portions and having a center bore increasing its diameter from the bottom to the top of the bore.

4. A multiway change-over switch for a circuit comprising:

an electrically insulated hollow cylindrical casing including a main body portion which defines a switching chamber and a head portion which defines a lobed opening, an upper terminal having a portion positioned on the inner surface of the top wall of said switching chamber, a rocking change-over means rockably received in said switching chamber in contact with said upper terminal, a lower terminal in abutment against the undersurface of said rocking change-over means for rockably supporting the rocking change-over means, a base member secured to the bottom of said casing and loosely receiving said lower terminal, a coiled spring positioned between said lower terminal and base member for normally urging said lower terminal against said rocking change-over means and at least one pair of peripheral terminals positioned in diametrically opposite positions in the outer periphery of said base member and having portions extending into said switching chamber to surround said rocking change-over means, said rocking change-over means including a substantially hollow cylindrical operation member having an annular projection in the center of the outer periphery against which said peripheral terminals normally abut, an upper contact surrounding the portion of said operation member above said annular projection and normally in contact with said upper terminal and a lower contact surrounding the portion of said operation member below said annular projection and normally in contact with said lower terminal such that said rocking change-over means can selectively contact said at least one pair of peripheral terminals with said upper and lower terminals and complete said circuit and, an annular conductive leaf spring interposed between said upper terminal and said rocking change-over means and said upper terminal is in the form of an annular plate.

5. A multiway change-over switch for a circuit comprising:

an electrically insulated hollow cylindrical casing including a main body portion which defines a switching chamber and a head portion which defines a lobed opening, an upper terminal having a portion positioned on the inner surface of the top wall of said switching chamber, a rocking change-over means rockably received in said switching chamber in contact with said upper terminal, a lower terminal in abutment against the undersurface of said rocking change-over means for rockably supporting the rocking change-over means, a base member secured to the bottom of said casing and loosely receiving said lower terminal;

a coiled spring positioned between said lower terminal and base member for normally urging said lower terminal against said rocking change-over means and at least one pair of peripheral terminals positioned in diametrically opposite positions in the outer periphery of said base member and having portions extending into said switching chamber to surround said rocking change-over means, said rocking change-over means including a substantially hollow cylindrical operation member having an annular projection in the center of the outer periphery against which said peripheral terminals normally abut, an upper contact surrounding the portion of said operation member above said annular projection and normally in contact with said upper terminal and a lower contact surrounding the portion of said operation member below said annular projection and normally in contact with said lower terminal such that said rocking change-over means can selectively contact said at least one pair of peripheral terminals with said upper and lower terminals and complete said circuit, an operation lever having a portion loosely received in the lobed opening for rocking movement and a portion snugly fitted in said rocking change-over means so that when the operation lever is rocked, the rocking change-over means rocks within said switching chamber together with the operation lever to complete said circuit in which said upper contact has a substantially inverted cup shape having a center opening in the bottom within which a portion of said operation member is positioned and said lower contact has a substantially cup shape, the bottom of which is bent upwardly.

6. The multiway change-over switch as set forth in claim 1, in which two pairs of peripheral terminals are provided and the two peripheral terminals in each pair are positioned apart from each other by 180°.

7. The multiway change-over switch as set forth in claim 5, in which the upper end face of said lower terminal is semispherical to serve as the fulcrum for rocking movement of said rocking change-over means in cooperation with said upwardly bent bottom of the lower contact.

8. The multiway change-over switch as set forth in claim 1, in which said upper and lower contacts selectively engage said peripheral terminals as said rocking change-over means rocks.

* * * * *